US010501974B2

(12) United States Patent
Issler et al.

(10) Patent No.: US 10,501,974 B2
(45) Date of Patent: Dec. 10, 2019

(54) FITTING ARRANGEMENT FOR CONNECTING A SLIDABLE AND TILTABLE LEAF

(71) Applicant: ROTO FRANK AG, Leinfelden-Echterdingen (DE)

(72) Inventors: Thorsten Issler, Dettenhausen (DE); Stefan Fingerle, Rommelsbach (DE); Markus Peter, Neurtingen (DE); Tamás Nyikos, Sopron (HU); Wolfgang Krieger, Waiblingen (DE); Gyoergy Kiss, Gencsapáti (HU)

(73) Assignee: ROTO FRANK AG, Leinfelden-Echterdingen (DE)

( * ) Notice: Subject to any disclaimer, the term of this patent is extended or adjusted under 35 U.S.C. 154(b) by 0 days.

(21) Appl. No.: 15/999,053

(22) PCT Filed: Feb. 9, 2017

(86) PCT No.: PCT/EP2017/052873
§ 371 (c)(1),
(2) Date: Aug. 16, 2018

(87) PCT Pub. No.: WO2017/140573
PCT Pub. Date: Aug. 24, 2017

(65) Prior Publication Data

US 2019/0345750 A1 Nov. 14, 2019

(30) Foreign Application Priority Data

Feb. 17, 2016 (DE) ..... 10 2016 202 377

(51) Int. Cl.
*E05D 15/10* (2006.01)
*E05D 15/58* (2006.01)

(52) U.S. Cl.
CPC ..... *E05D 15/1015* (2013.01); *E05D 15/58* (2013.01); *E05D 2015/1026* (2013.01);
(Continued)

(58) Field of Classification Search
CPC ..... E05D 15/1013; E05D 15/1015; E05D 15/581; E05D 2015/485
See application file for complete search history.

(56) References Cited

U.S. PATENT DOCUMENTS 4,453,345 A * 6/1984 Maus ..... E05D 15/10 49/176
4,794,730 A * 1/1989 Fischbach ..... E05D 15/1013 49/130
(Continued)

FOREIGN PATENT DOCUMENTS

DE 29514829 U1 * 1/1997 ..... E05D 15/1015
DE 202008004033 U1 7/2009
(Continued)

OTHER PUBLICATIONS

International Search Report of PCT/EP2017/052873, dated Apr. 26, 2017.
(Continued)

*Primary Examiner* — Catherine A Kelly
(74) *Attorney, Agent, or Firm* — Collard & Roe, P.C.

(57) ABSTRACT

A fitting assembly for a window or door includes a leaf tiltable and detachable from, and slidable parallel to, the fixed window or door frame, and a control element with a fastener mountable permanently on the frame and an insertion part pivotable and slidable relative to the fastener. In an insertion position, in which a control pin is pushable into the insertion part, an insertion part end section lies preferably partially against the fastener for conducting away control pin-insertion part impact into the fastener via the end
(Continued)

section. The insertion part may pivot out of interlocking engagement with the fastener by a control arm on which the control pin may be located or formed, such that subsequently the insertion part can slide via the control pin. The control element can have a freewheel mechanism for pivoting the insertion part only during fitting assembly opening and not during closing.

14 Claims, 6 Drawing Sheets

(52) U.S. Cl.
CPC . *E05D 2015/1031* (2013.01); *E05Y 2201/694* (2013.01); *E05Y 2600/53* (2013.01); *E05Y 2900/148* (2013.01)

(56) References Cited

U.S. PATENT DOCUMENTS 4,802,307 A * 2/1989 Schmidt ..... E05D 15/1015 49/130
5,836,111 A * 11/1998 Tak ..... E05D 15/10 49/425

FOREIGN PATENT DOCUMENTS

| | | | | | |
|---|---|---|---|---|---|
| DE | 202012002741 | U1 * | 4/2012 | ..... | E05C 9/063 |
| DE | 10 2014 216 722 | A1 | 2/2016 | | |
| DE | 102014216722 | A1 * | 2/2016 | ..... | E05D 15/1015 |
| DE | 102015222116 | B3 * | 11/2016 | ..... | E05D 15/1013 |
| DE | 202015106047 | U1 * | 2/2017 | ..... | E05D 15/1013 |
| DE | 102017217220 | A1 * | 3/2019 | ..... | E05D 15/1015 |
| EP | 0 600 102 | A1 | 6/1994 | | |
| EP | 1 959 080 | A2 | 8/2008 | | |
| EP | 2 824 264 | A1 | 1/2015 | | |
| WO | 2016/026805 | A1 | 2/2016 | | |
| WO | WO-2017157611 | A1 * | 9/2017 | ..... | E05D 15/1015 |

OTHER PUBLICATIONS

German Office Action in DE 10 2016 202 377.2 dated Nov. 14, 2016 with English translation of relevant parts.
Response by German Patent Attorney to European Patent Office regarding PCT/EP2017/052873 dated Nov. 13, 2017 with English translation of relevant parts.
Russian Search Report and Decision to Grant a Patent dated Nov. 29, 2018 in Russian Application No. 201813273/12 (053622) with English translation of the relevant parts.

* cited by examiner

FITTING ARRANGEMENT FOR CONNECTING A SLIDABLE AND TILTABLE LEAF

CROSS REFERENCE TO RELATED APPLICATIONS

This application is the National Stage of PCT/EP2017/052873 filed on Feb. 9, 2017, which claims priority under 35 U.S.C. § 119 of German Application No. 10 2016 202 377.2 filed on Feb. 17, 2016, the disclosures of which are incorporated by reference. The international application under PCT article 21(2) was not published in English.

The invention relates to a fitting arrangement for connecting a slidable and tiltable leaf to a fixed frame of a window or a door, wherein the fitting arrangement has a scissor type deployment means having a deployment arm and a control arm which is movably arranged on the deployment arm, wherein the scissor type deployment means has a control pin and the fitting arrangement further has a control element having a fixing portion which can be fixed to the fixed frame and an introduction portion having a slotted introduction member for receiving the control pin. The invention further relates to a window or door having such a fitting arrangement.

It is known to provide windows, doors or the like with a slidable leaf. In order to open the leaf, the leaf is released from a closure position, in which it abuts the fixed frame, in a pivot movement from the fixed frame and then displaced parallel with the main plane of the fixed frame. In this case, the leaf is connected to the fixed frame via at least one scissor type deployment means of a fitting arrangement. In the released position of the leaf, the scissor type deployment means is engaged in a release position. The leaf is thereby prevented from pivoting back during displacement of the leaf. Such a displaceable leaf has become known from EP 1 959 080 A2.

During closure of the leaf, a control pin strikes a control element which is described in the introduction. Such a control element is also known by the term "control block". The control element is mounted on the fixed frame directly or indirectly, for example, indirectly via a mounting rail. The control pin is introduced into the slotted introduction member of the control element, whereby the engagement of the scissor type deployment means is cancelled and the leaf can be pivoted inwards again.

EP 2 824 264 A1 disclosed a fitting arrangement for a window or a door, by means of which a leaf can be both released parallel from a fixed frame and tilted. However, the known control element of EP 2 824 264 A1 is constructed with a relatively big depth in the main frame plane of the fixed frame or parallel with this main frame plane of the fixed frame.

Therefore, an object of the invention is to provide a fitting arrangement which allows both displacement and tilting of a leaf of a window or door in a small structural space. Another object of the invention is to provide a window or a door having such a fitting arrangement.

Consequently, the object according to the invention is achieved by a fitting arrangement for connecting a slidable and tiltable leaf to a fixed frame of a window or a door. The fitting arrangement has a scissor type deployment means having a deployment arm and a control arm. The scissor type deployment means, in particular the control arm, has a control pin. The fitting arrangement further has a control element. The control element has a fixing portion which can be fixed in a non-movable manner to the fixed frame of the window or door.

The control element further has an introduction portion which can be moved relative to the fixing portion. More specifically, the introduction portion is arranged so as to be movable relative to the fixing portion between an introduction position and a tilted position. The introduction portion has a slotted introduction member for receiving the control pin. In the introduction position, the control pin can be introduced and withdrawn into/from a slotted introduction member of the introduction portion while it cannot be introduced and withdrawn into/from the slotted introduction member in the tilted position but instead is retained by the fixing portion in the slotted introduction member. According to the invention the introduction portion now directly adjoins in the introduction position itself the fixing portion partially in a positive-locking manner (form fit/form lock). If the control pin in this introduction position is introduced into the slotted introduction member, the impact of the control pin is discharged via the positive-locking connection of the introduction portion with respect to the fixing portion into the fixing portion and finally into the fixed frame. The impact does not result in the introduction portion being moved into the tilted position. Instead, the introduction portion can be moved into the tilted position by the control pin only when the scissor type deployment means moves the introduction portion out of the positive-locking connection with respect to the fixing portion.

Consequently, according to the invention there is provided a fitting arrangement which, on the one hand, allows a linear tilting movement of a leaf which is mounted on the fitting arrangement by the movement of the introduction portion into the fixing portion and, on the other hand, allows a reliable stop for the control pin during closure of a leaf from the released position thereof by the partial positive-locking connection of the introduction portion with respect to the fixing portion in the introduction position.

A corner region of the introduction portion preferably forms the partial positive-locking connection of the introduction portion with respect to the fixing portion in the introduction position.

The fixing portion may have an introduction recess in which the introduction portion in the introduction position abuts in a partially positive-locking manner. In this case, the scissor type deployment means is constructed to move the introduction portion out of the introduction recess during opening of the scissor type deployment means so that the introduction portion can be moved by the control pin into the tilted position during further opening of the scissor type deployment means.

The movement of the introduction portion out of the partial positive-locking connection is preferably carried out by a pivoting movement of the introduction portion. The further movement of the introduction portion into the tilted position is preferably carried out in the fixing portion by a linear sliding movement of the introduction portion.

The pivoting of the introduction portion out of the introduction position can be carried out about the axis of a fixing pin which is arranged at one end on the introduction portion and which is guided at the other end in a slotted fixing member.

The pivoting of the introduction portion out of the introduction position is preferably carried out about the axis of the control pin or parallel with the axis of the control pin. The fitting arrangement can thereby be constructed in a structurally particularly simple manner.

In another preferred embodiment of the invention, the introduction portion is moved by the control arm out of the introduction position during opening of the scissor type deployment means.

In order to prevent the introduction portion from already being moved out of the partial positive-locking connection with respect to the fixing portion when the scissor type deployment means is closed and the occurrence of jamming of the scissor type deployment means when the leaf is closed, the control element preferably has a free-running member which is constructed in such a manner that the introduction portion is moved out of the partial positive-locking connection with respect to the fixing portion only when the scissor type deployment means is opened.

The free-running member may have a free-running pin which is acted on by a free-running spring of the free-running member with a resilient force, wherein the scissor type deployment means is constructed in such a manner that the free-running pin is redirected during closure of the scissor type deployment means and no movement of the introduction portion out of the partial positive-locking connection with respect to the fixing portion is thereby carried out, wherein no redirection or only a negligible redirection of the free-running pin counter to the resilient force of the free-running spring is carried out when the scissor type deployment means is opened so that the scissor type deployment means moves the free-running pin together with the introduction portion out of the partial positive-locking connection of the introduction portion with respect to the fixing portion.

The control arm is preferably arranged at one end in a pivotable manner on the deployment arm and, at the other end, is constructed in a sawtooth-like manner, wherein the gradient of a first flank of the sawtooth displaces the free-running pin and a second flank of the sawtooth is constructed to be so steep relative to the free-running pin that the control arm does not displace the free-running pin. The second flank may be constructed in a semi-circular manner.

In another embodiment of the invention, the control element may have a reversibly releasable engagement device on the introduction portion in order to allow a reversibly releasable engagement connection in the tilted position of the introduction portion with respect to the fixing portion. This prevents the leaf from slamming shut in the tilted position as a result of a gust of wind. Alternatively or additionally, the engagement device can press the introduction portion in the introduction position into the partial positive-locking connection with respect to the fixing portion. The introduction portion is thereby reliably retained in the introduction position at least partially in a positive-locking manner with respect to the fixing portion so that an impact which is brought about by the control pin which is introduced into the slotted introduction member is discharged reliably into the fixing portion or further into the fixed frame.

In this case, the engagement device may have an engagement spring and an engagement element which is acted on with a resilient force by the engagement spring. The engagement element is preferably constructed in the form of a ball for simplified construction of the fitting arrangement.

A reliable discharge of the impact produced by the control pin into the fixing portion or further into the fixed frame is brought about if the fixing portion has a stop face for the control pin which merges into a side wall of the slotted introduction member in the introduction portion.

In a further preferable manner, the control element has a slotted guiding member so that the introduction portion can be moved relative to the fixing portion but is arranged in a non-releasable manner on the fixing portion.

The control pin may have an end-side head portion with an expanded cross-section. In other words, the control pin may be constructed in a substantially mushroom-like manner so that it can be guided in a particularly reliable manner by rear engagement which is brought about at least partially in the control element.

The scissor type deployment means may be able to be mounted at one end directly on the leaf. The fitting arrangement preferably has at one end of the scissor type deployment means a leaf rail which can be mounted on the leaf. The fitting arrangement preferably has at the other end of the scissor type deployment means a slider of the fitting arrangement, which slider is movable, preferably slidable, directly or indirectly on the fixed frame. The slider may be constructed in the form of a slider rail. The leaf rail and slider rail may be connected to each other via another deployment arm in addition to the scissor type deployment means.

In order to guide the opening and closing movement of the scissor type deployment means, the control arm may have a control arm slotted guiding member, in which a control arm guide bolt, in particular of the slider, engages. As set out in the introduction, the scissor type deployment means is engaged in the release position, that is to say, in the released position of the leaf. The control arm slotted guiding member preferably has at one end an engagement indentation in which the control arm guide bolt engages in this open position of the scissor type deployment means. The movement of the control pin into the slotted introduction member is used in this case to guide the control arm guide bolt out of the engagement indentation.

The fitting arrangement according to the invention can preferably be controlled only by a movement of the leaf but not by a push rod. In other words, the fitting arrangement is not in this case a force-controlled fitting arrangement but instead only passively affords the movement possibility for the leaf which is moved by a user.

The object according to the invention is finally achieved by a window or a door having an above-described fitting arrangement, wherein the fitting arrangement connects a fixed frame of the window or door to a tiltable and slidable leaf of the window or door and the fixing portion is mounted in a non-movable manner relative to the fixed frame.

Other features and advantages of the invention will be appreciated from the following detailed description of an embodiment of the invention, with reference to the Figures of the drawings which show the inventively significant details, and from the patent claims.

The features illustrated in the drawings are depicted in such a manner that the particular features according to the invention can be made clearly visible. The different features may be implemented individually per se or together in any combinations in variants of the invention.

Figure 4:
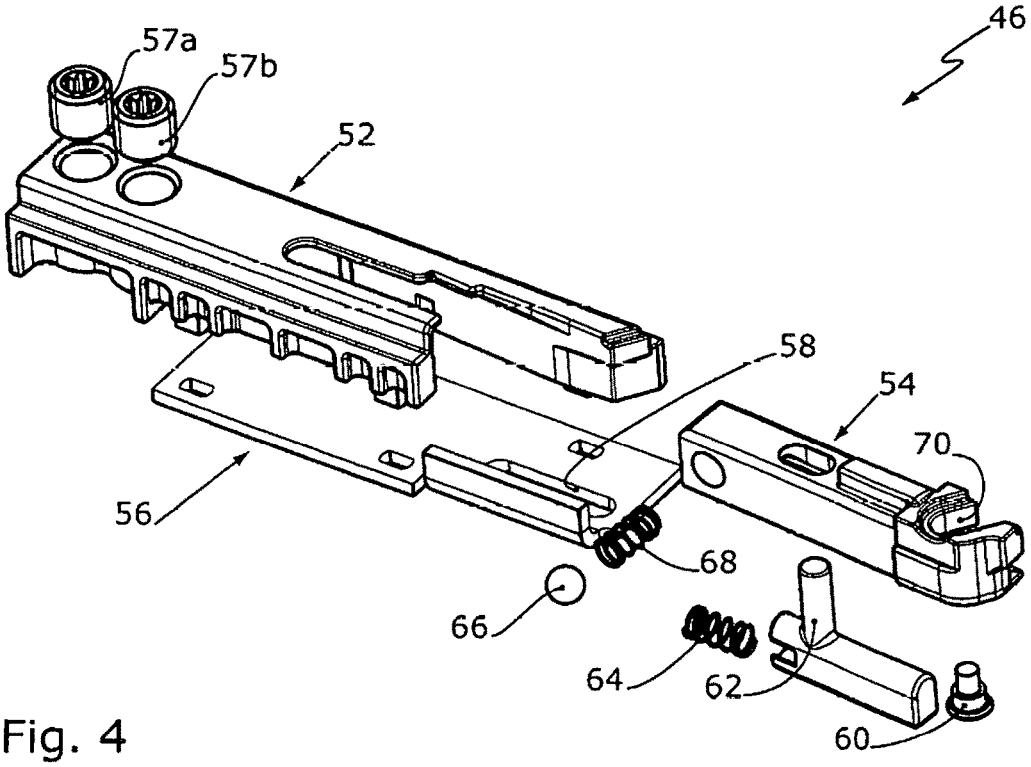
FIG. 4 is an exploded view of a control element of the fitting arrangement according to FIG. 3.
Figure 5A:
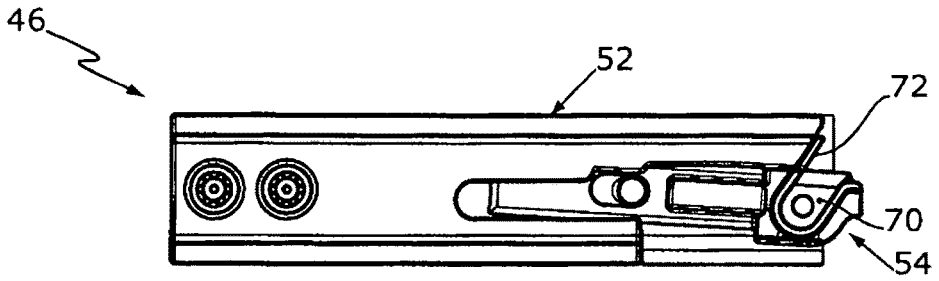
Figure 5B:
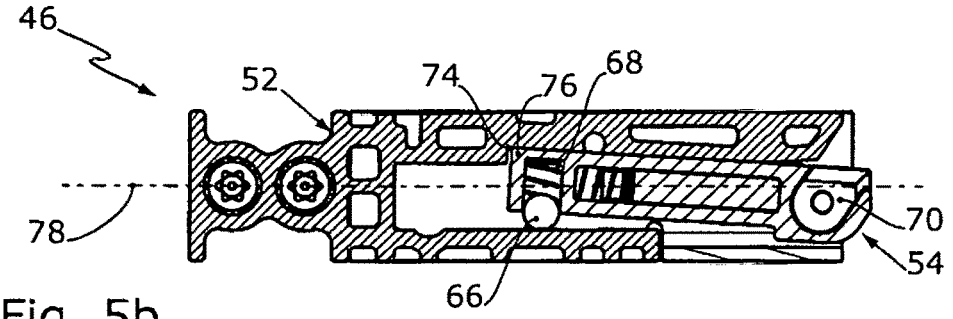

FIG. 5*a* is a plan view of the control element according to FIG. 4;

FIG. 5*b* is a longitudinal section through the control element according to FIG. 5*a;*

Figure 3:
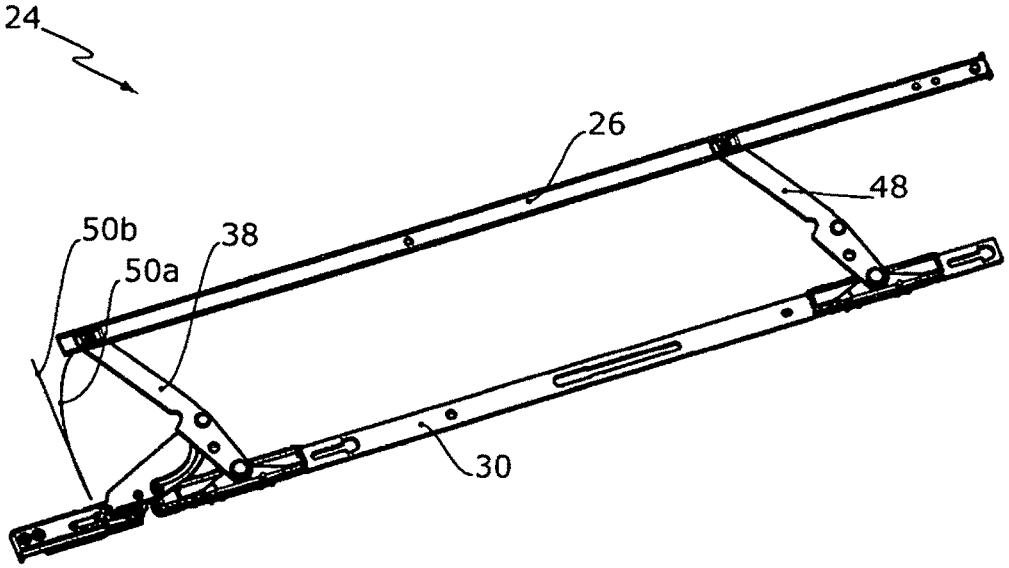
FIG. 3 is a perspective view of the fitting arrangement without a window.
Figure 6:
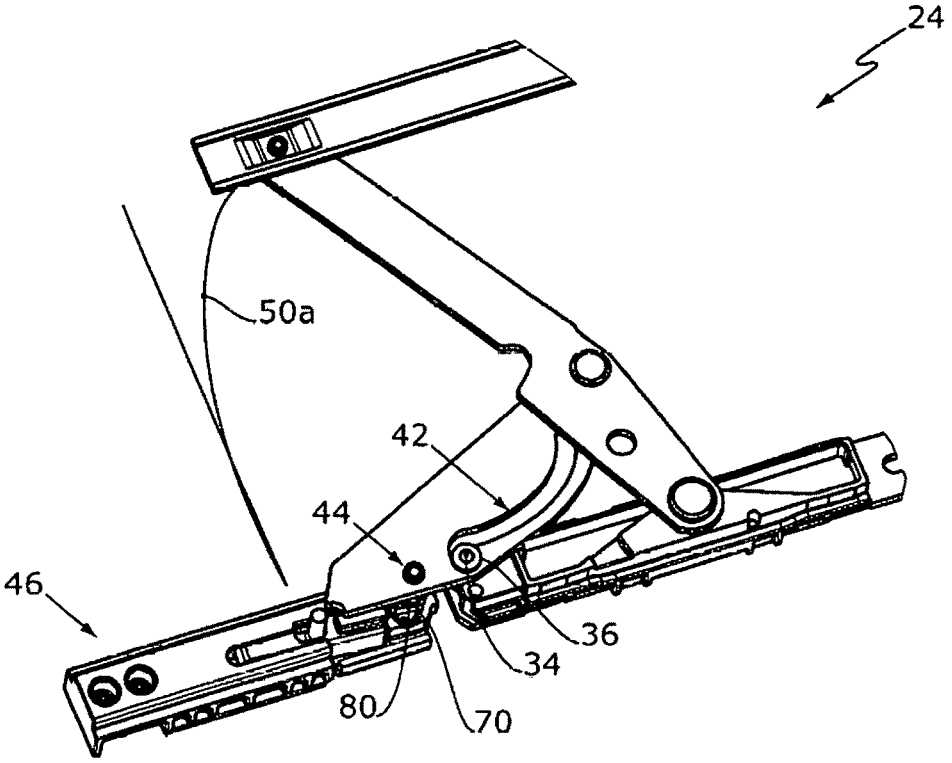
Figure 7:
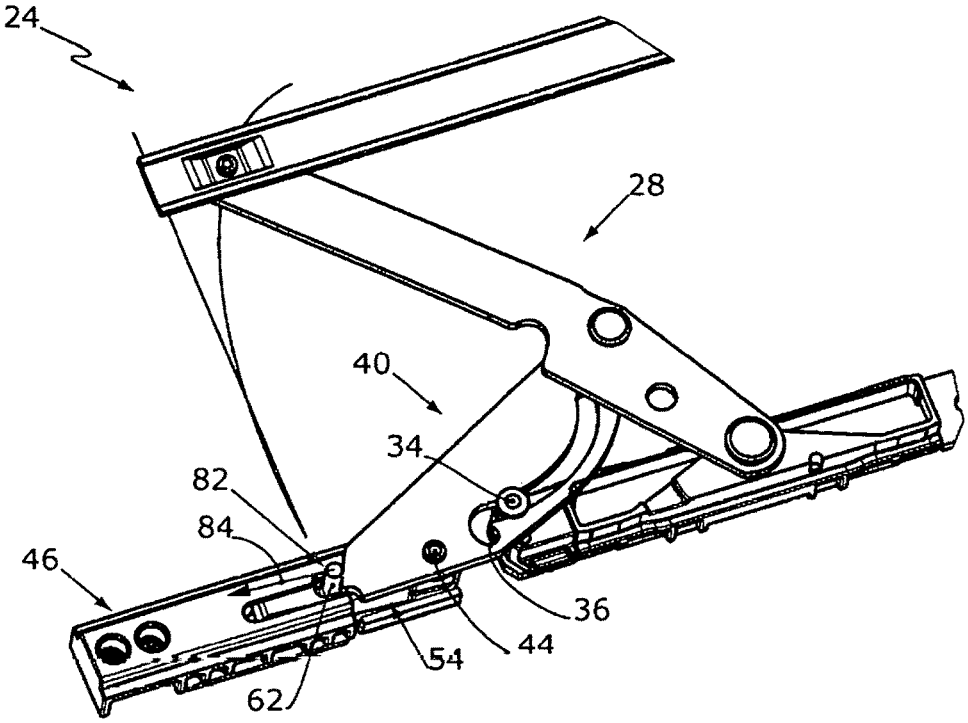
Figure 8:
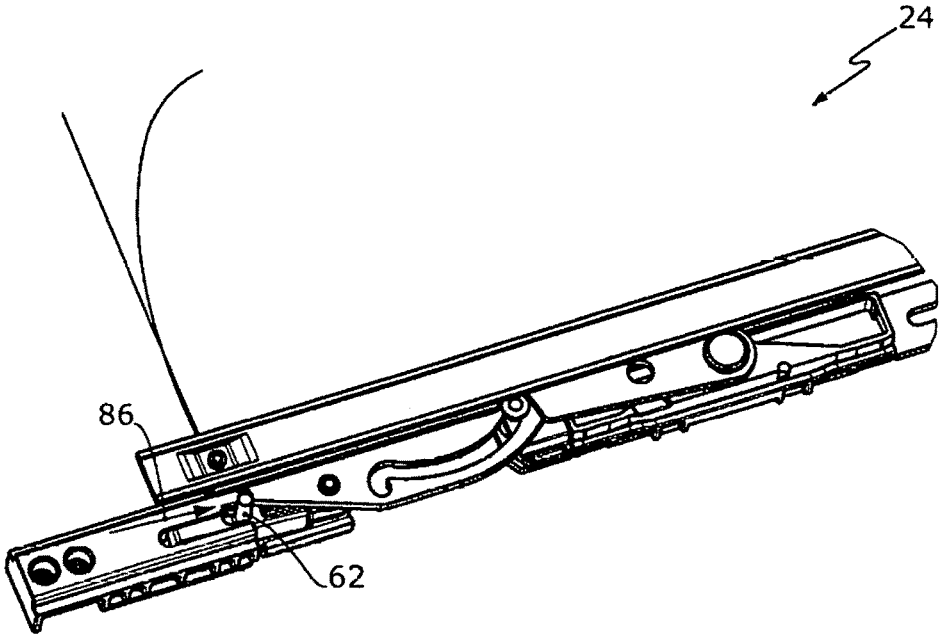
Figure 9:
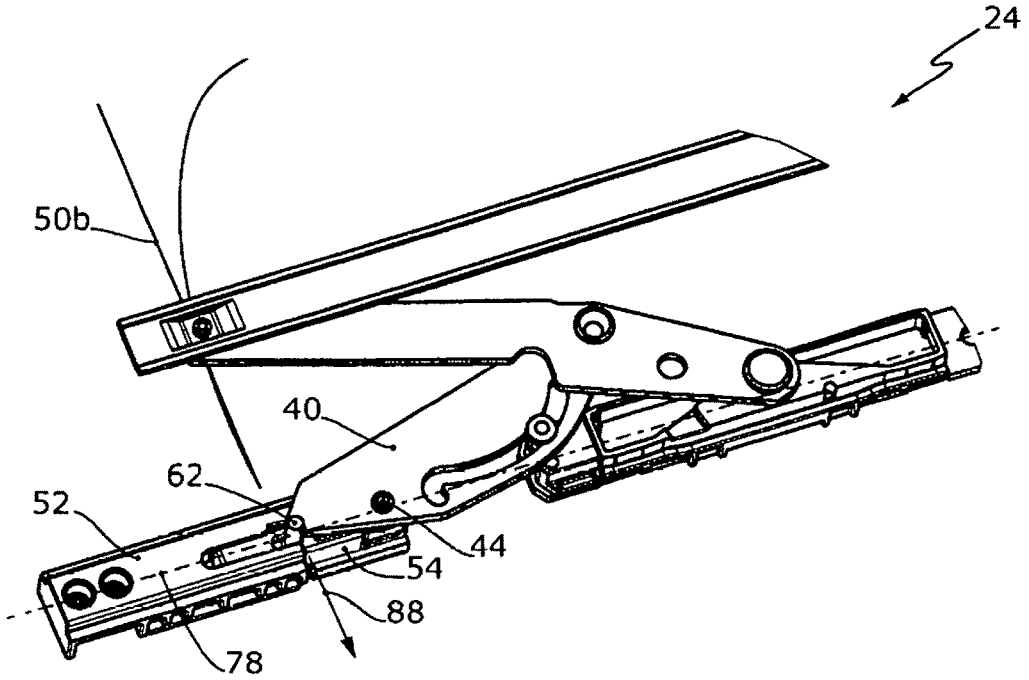
Figure 10:
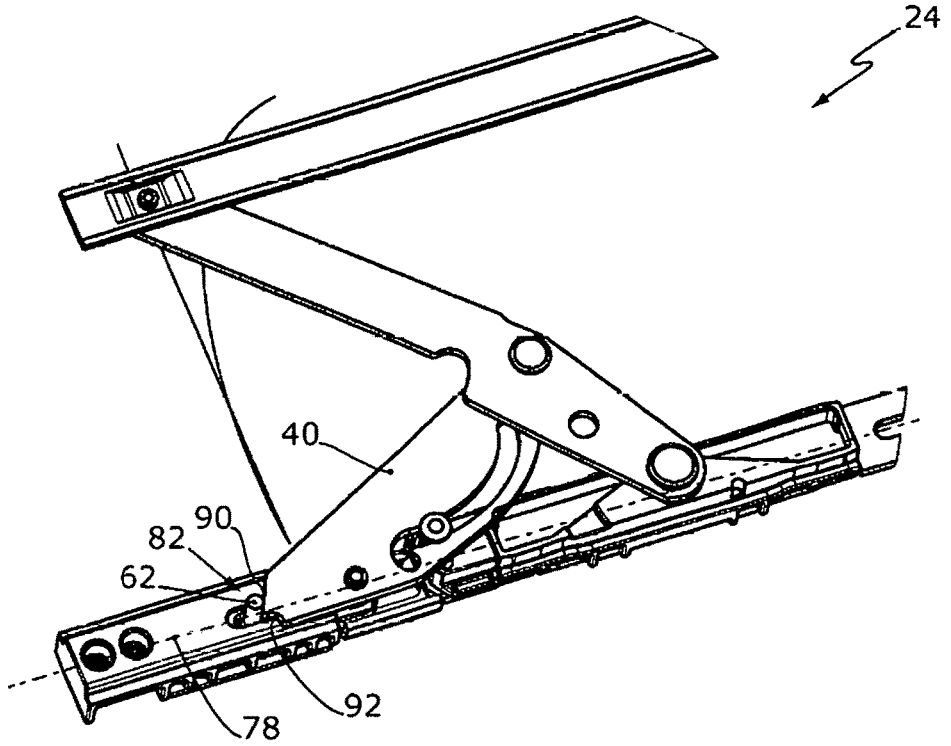
Figure 11A:
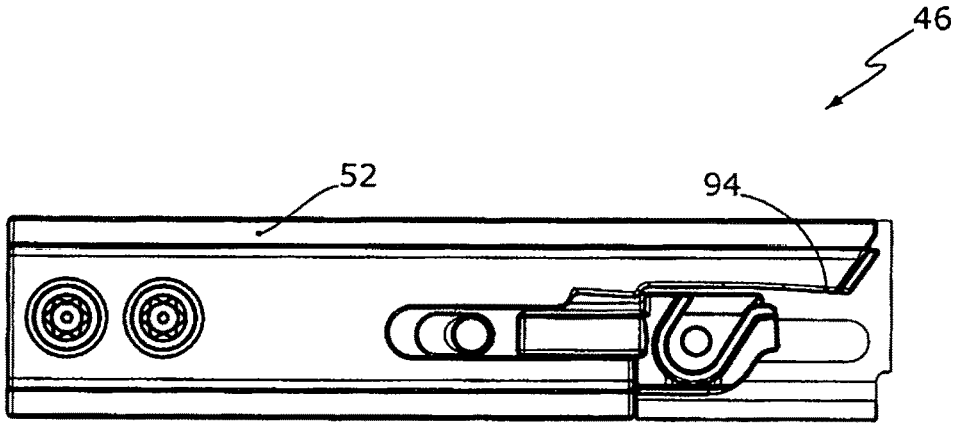
Figure 11B:
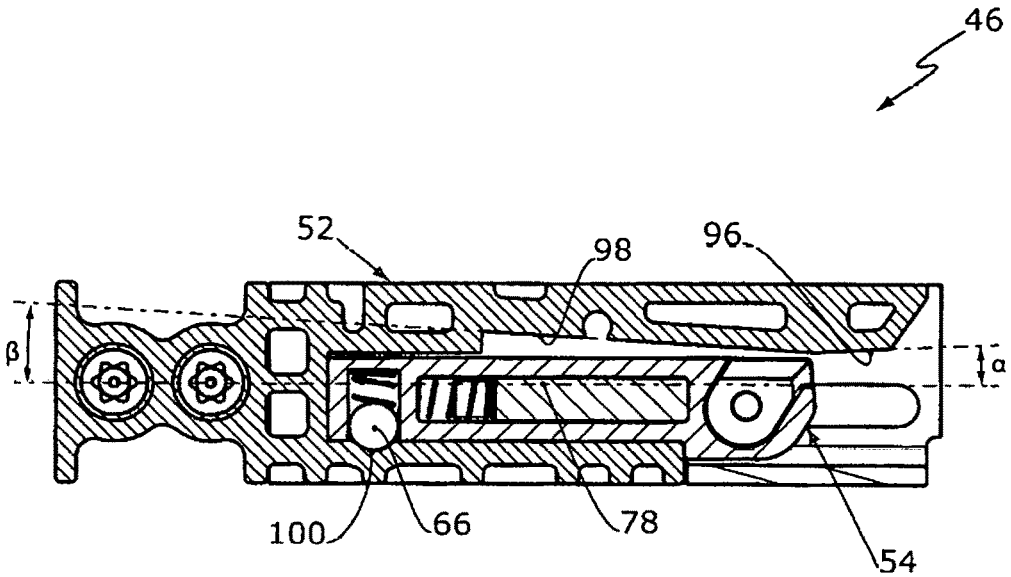

FIG. 6 is a perspective view of a cutout of the fitting arrangement according to FIG. 3 in the release position;

FIG. 7 is a perspective view of the fitting arrangement according to FIG. 6 during closure of a scissor type deployment means of the fitting arrangement;

FIG. 8 is a perspective view of the fitting arrangement according to FIG. 7 with a completely closed scissor type deployment means;

FIG. 9 is a perspective view of the fitting arrangement according to FIG. 8 during opening of the scissor type deployment means into the tilted position;

FIG. 10 is a perspective view of the fitting arrangement according to FIG. 9 in the tilted position;

FIG. 11*a* is a plan view of the control element according to FIG. 5*a* in the tilted position; and FIG. 11*b* is a longitudinal section through the control element according to FIG. 11*a*.

Figure 1:
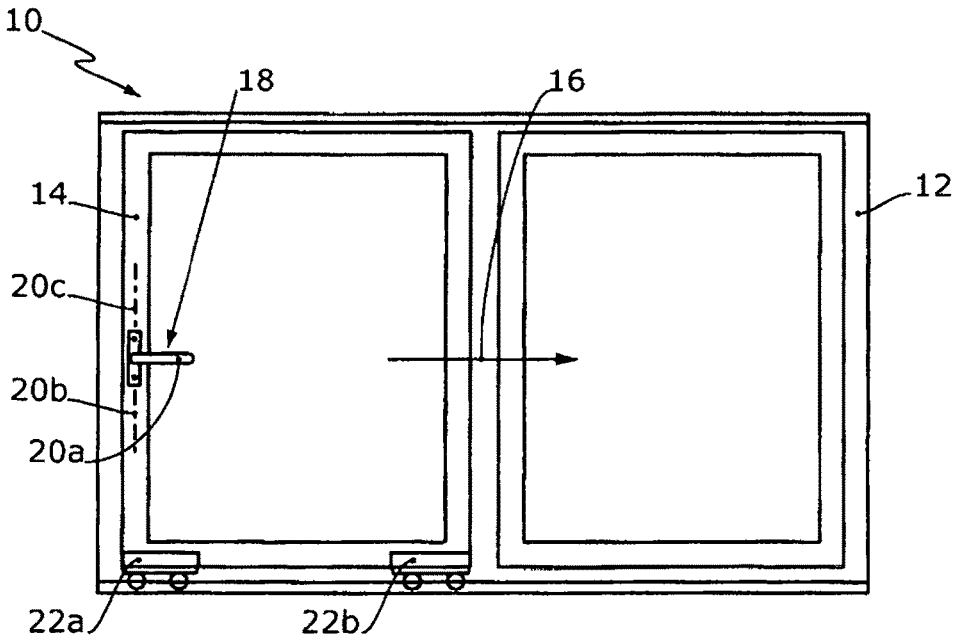
FIG. 1 is a schematic view of a window with a slidable and tiltable leaf.

FIG. 1 shows a window 10 having a fixed frame 12. A leaf 14 is displaceable relative to the fixed frame 12 (here in the direction of an arrow 16). The leaf 14 can be released from the fixed frame 12 and is displaceable if a handle 18 is in the first position 20*d* shown in FIG. 1. However, if the handle 18 is pivoted by a user into a second position 20*b*, the leaf 14 is arranged in a closed state on the fixed frame 12. If the handle 18 is pivoted into a third position 20*c*, the leaf 14 can be tilted, that is to say, can be released at the top from the fixed frame 12, while it is retained on the fixed frame 12 at the bottom. The displacement of the leaf 14 relative to the fixed frame 12 is carried out by means of carriages 22*a*, 22*b*.

The fitting arrangement 24 according to the invention (see FIG. 2) may alternatively make the leaf 14 able to be opened by means of tilting—depending on the lower-side construction or control of the leaf 14 (see FIG. 1)—if the handle 18 (see FIG. 1) is in the first position 20*a* and may make it releasable in a parallel manner if the handle 18 is in the third position 20*c* (see FIG. 1).

Figure 2:
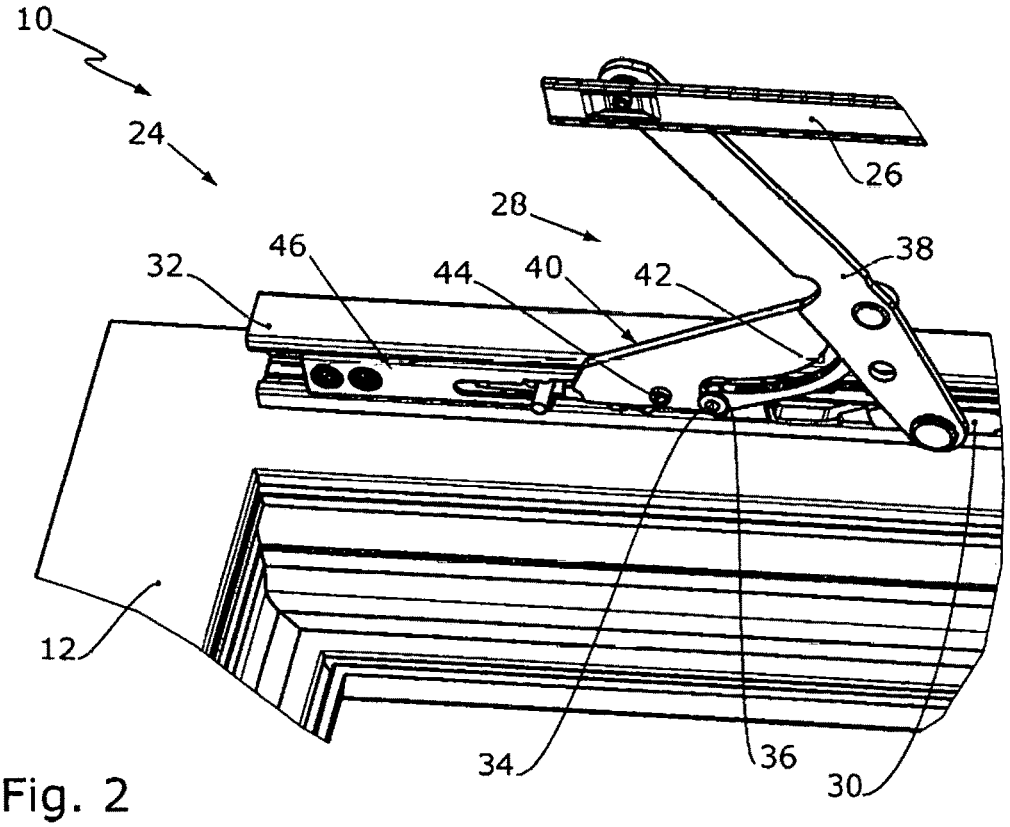
FIG. 2 is a perspective view of a portion of the window according to FIG. 1 with a portion of a fitting arrangement.

FIG. 2 is a cutout of the window 10 according to FIG. 1 without the leaf 14 (see FIG. 1). FIG. 2 shows that a fitting arrangement 24 is mounted on the fixed frame 12 at the upper side. The fitting arrangement 24 is positioned on the fixed frame 12. The fitting arrangement 24 has a leaf rail 26 which can be connected to the leaf 14 (see FIG. 1). The leaf rail 26 is connected to a slider 30 via a scissor type deployment means 28.

The fitting arrangement 24 has a mounting rail 32 which is mounted securely on the fixed frame 12. The slider 30 is movable in the longitudinal direction of the mounting rail 32 in order to be able to displace the leaf 14 (see FIG. 1) parallel with the main frame plane of the fixed frame 12 (see arrow 16 according to FIG. 1). FIG. 2 shows the fitting arrangement 24 in the release position. In this release position, a control arm guide bolt 34 is in an engagement indentation 36 (cf. also FIG. 7) of the scissor type deployment means 28. As long as the control arm guide bolt 34 engages in the engagement indentation 36, the leaf 14 mounted on the leaf rail 26 (see FIG. 1) cannot pivot in towards the fixed frame 12.

In order to close the window 10 (see FIG. 1), the control arm guide bolt 34 must move out of the engagement indentation 36. A deployment arm 38 of the scissor type deployment means 28 can then be pivoted relative to a control arm 40 of the scissor type deployment means 28 into the closed position of the scissor type deployment means 28. During the closing movement of the scissor type deployment means 28, the control arm guide bolt 34 is guided in a control arm slotted guiding member 42 of the control arm 40.

In order to move the control arm guide bolt 34 out of the engagement indentation 36, the control arm 40 is pivoted. The pivoting is brought about by a control pin 44 which is guided by a control element 46.

FIG. 3 shows the fitting arrangement 24, the leaf rail 26 of which is guided by the deployment arm 38 and an additional deployment arm 48 parallel with the slider 30. In this case, the slider 30 is constructed in the form of a slider rail.

FIG. 3 shows a first trajectory 50*a* which shows the pivoting opening action of the leaf rail 26 or the leaf 14 which is fixed thereto (see FIG. 1) into the release position. A second trajectory 50*a* shows the movement of the leaf rail 26 or the leaf 14 which is fixed thereto (see FIG. 1) into the tilted position. The fitting arrangement 24 shown in FIG. 3 consequently allows both a movement of the leaf rail 26 into the deployment position, in which the leaf rail 26 is released parallel with the main frame plane of the fixed frame 12 (see FIG. 1, particularly arrow 16) in accordance with the first trajectory 50*a*, and a movement of the leaf rail 26 in accordance with the second trajectory 50*b* into the tilted position.

FIG. 4 shows the control element 46. The control element 46 has a fixing portion 52 and an introduction portion 54 which can be moved relative to the fixing portion 52. The fixing portion 52 can be fixed together with a mounting plate 56 in the mounting rail 32 (see FIG. 2) and consequently at least indirectly securely fixed to the fixed frame 12 (see FIG. 2). In order to fix the fixing portion 52 in the mounting rail 32 (see FIG. 2), the control element 46 has screws 57*a*, 57*b*.

In order to retain the introduction portion 54 in a non-releasable manner relative to the fixing portion 52, the mounting plate 56 has a slotted guiding member having a slotted fixing member 58, in which at one end a fixing pin 60 which is arranged at the other end on the introduction portion 54 is guided.

A free-running pin 62 which can be displaced relative to the introduction portion 54 and which is acted on with the resilient force of a free-running spring 64 is arranged on the introduction portion 54. Furthermore, an engagement element 66 which is acted on with the resilient force of an engagement spring 68 is arranged on the introduction portion 54. The introduction portion 54 further has a slotted introduction member 70 for receiving the control pin 44.

FIG. 5*a* shows the control element 46 in the mounted state. According to FIG. 5*a*, the control element 46, more specifically the introduction portion 54, is in the introduction position. In this introduction position, a stop face 72 of the fixing portion 52 opens in the slotted introduction member 70. If the leaf 14 (see FIG. 1) is closed, that is to say, moved counter to the direction of the arrow 16 (see FIG. 1), the control pin 44 moves (see FIG. 2) against the stop face 72 and, in the case of further movement of the leaf 14 (see FIG. 1) counter to the direction of the arrow 16 (see FIG. 1), further into the slotted introduction member 70.

FIG. 5*b* shows the control element 46 according to FIG. 5*a* as a section parallel with the plane of the drawing. FIG. 5*b* shows that the fixing portion 52 has an introduction recess 74 in which the introduction portion 54 abuts in a partially positive-locking manner with a corner region 76. This corner region 76 is preferably located at one end of the introduction portion 54 which is opposite the slotted introduction member 70. In the introduction position of the control element shown in FIG. 5*b*, the introduction portion 54 cannot be displaced in the direction of the longitudinal axis 78 of the fixing portion 52. The longitudinal axis 78 of the fixing portion 52 corresponds in particular to the longitudinal axis of the mounting rail 32 (sec FIG. 2).

If the leaf 14 (see FIG. 1) is closed, high forces can be applied by the control pin 44 (see FIG. 2) to the introduction portion 54 during the introduction into the introduction portion 54 as a result of a high leaf weight, in particular in the case of multiple-glazing of the leaf 14. In this case, the partial positive-locking connection of the corner region 76 in the introduction recess 74 reliably prevents the introduction portion 54 from being deflected by this impact. The impact which is transmitted by the leaf 14 (see FIG. 1) via the control pin 44 (see FIG. 2) to the introduction portion 54 is consequently reliably discharged into the fixing portion 52 and further, in particular via the mounting rail 32 (see FIG. 2), into the fixed frame 12 (see FIG. 2). In this case, the engagement spring 68 presses in a state supported on the engagement element 66 the introduction portion 54 with the corner region 76 thereof into the introduction recess 74.

FIG. 6 shows the fitting arrangement 24 in the release position. In this release position, the leaf 14 (see FIG. 1) is released parallel with the main plane of the fixed frame 12 (see FIG. 1). The control arm guide pin 34 is located in the engagement indentation 36 of the control arm slotted guiding member 42. In order to close the leaf 14 (see FIG. 1), that is to say, to pivot the leaf 14 inwards according to the first trajectory 50*a*, the control pin 44 moves into the slotted introduction member 70. In this case, a particularly reliable guiding of the control pin 44 on the control element 46 is ensured by a thickening 80 on the control pin 44, by means of which the control pin 44 can partially engage behind the control element 46.

FIG. 7 shows the further closure of the fitting arrangement 24. By the control pin 44 being introduced into the slotted introduction member 70 (see FIG. 6), the control arm guide pin 34 is moved out of the engagement indentation 36. The scissor type deployment means 28 can close. In order to ensure, in this closure movement of the scissor type deployment means 28, that the introduction portion 54 is not displaced by the control arm 40, but instead the slotted introduction member 70 (see FIG. 6) is reliably available in a fixed manner as a guide for the control pin 44, the control element 46 has a free-running member 82. The free-running pin 62 of the free-running member 82 is displaced in this case during the closure movement of the scissor type deployment means 28 by the control arm 40 counter to the resilient force of the free-running spring 64 (see FIG. 4) of the free-running member 82. This displacement of the free-running pin 62 is indicated in FIG. 7 by an arrow 84.

FIG. 8 shows the fitting arrangement 24 in the closed state. In this closed state, the free-running pin 62 is moved backwards again by the force of the free-running spring 64 (see FIG. 4), as indicated in FIG. 8 by an arrow 86.

FIG. 9 shows the fitting arrangement 24 during the movement from the closed position (see FIG. 8) into a tilted position of the leaf 14 (see FIG. 1). The movement into the tilted position is carried out along the second trajectory 50*b*. Whether the leaf 14 (see FIG. 1) is moved into the release position (see FIG. 6) or a tilted position depends on whether the leaf 14 (see FIG. 1) is retained at the lower end on the fixed frame 12 (see FIG. 1) or not. This is controlled by means of the handle position and accordingly via the locking bolts which are arranged on the push rod, as in known rotating/tilting windows.

During the movement of the fitting arrangement 24 into a tilted position, the control pin 44 must be displaceable substantially along the longitudinal axis 78 of the fixing element 52 in order to allow the upper-side outward tilting of the leaf 14 (see FIG. 1) along the second trajectory 50*b*. However, the control pin 44 is only displaceable if the introduction portion 54 is displaceable with the slotted introduction member 70 thereof (see FIG. 5*a*) substantially along the longitudinal axis 78 or substantially parallel with the longitudinal axis 78. To this end, the control arm 40 moves the introduction portion 54 in the direction of an arrow 88 by the action of pressure on the free-running pin 62 out of the positive-locking connection with the fixing element 52.

FIG. 10 shows the fitting arrangement 24 in the tilted position. FIG. 10 shows that the free-running member 82 is brought about by cooperation of the free-running pin 62 with the end of the control arm 40. The end of the control arm 40 is constructed in a sawtooth-like manner in this case. A first flank 90 of the sawtooth-like shape has a slight gradient perpendicularly to the longitudinal axis 78 so that the free-running pin 62 is displaced along the first flank 90 in the event of a movement of the control arm 40. However, a second flank 92 of the sawtooth-like shape has a great gradient perpendicularly to the longitudinal axis 78 so that the free-running pin 62 is not displaced by the control arm 40 during pivoting of the control arm 40 but instead is carried along. The second flank 92 is constructed in a semi-circular manner.

FIG. 11*a* shows the control element 46 in the tilted position.

FIG. 11*b* is a cross-section through the control element 46 according to FIG. 11*a* parallel with the plane of the drawing. By comparing FIGS. 11*a* and 11*b*, it is evident that the fixing element 52 has a projection 94 (see FIG. 11*a*) which is engaged behind by the thickening 80 (see FIG. 6) of the control pin 44 in order to guide the control pin 44 (see FIG. 6) securely on the control element 46. FIG. 11*b* further shows that a straight guiding member 96, with which the control pin 44 (see FIG. 6) is guided with the thickening 80 thereof (see FIG. 6) during movement out of the control element 46, defines an angle $\alpha$ with the longitudinal axis 78. The angle $\alpha$ is between 1° and 10°, in particular between 2° and 6°. Furthermore, the fixing portion 52 has a straight abutment member 98, against which the introduction portion 54 abuts in the introduction position (cf. FIG. 5*b*). The straight abutment member 98 defines an angle ß with the longitudinal axis 78. The angle ß is between 1° and 20°, in particular between 3° and 10°.

The introduction portion 54 consequently has two degrees of freedom: in a first degree of freedom, the introduction portion 54 can be displaced substantially along the longitudinal axis 78 or substantially parallel with the longitudinal axis 78. In a second degree of freedom, the introduction portion 54 can be pivoted from the position thereof, in which the longitudinal axis thereof extends in the longitudinal axis 78 or parallel with the longitudinal axis 78, into the introduction position, in which an outer edge of the introduction portion 54 abuts the straight abutment member 98.

In the tilted position shown according to FIG. 11*b*, the engagement element 66 is arranged in an engagement recess 100 of the fixing portion 52. This makes it harder for the leaf 14 to slam closed (see FIG. 1) in the tilted position as a result of a gust of wind.

Taking all the Figures of the drawings together, the invention relates in summary to a fitting arrangement 24 for a window 10 or a door having a leaf 14 which can be both tilted and released from the fixed frame of the window 10 or door and displaced parallel with the fixed frame 12. The fitting arrangement 24 has a control element 46 with a fixing portion 52 which can be fixedly mounted on the fixed frame 12 indirectly and/or directly. The control element 46 has an introduction portion 54 which may be pivotable and displaceable relative to the fixing portion 52. In an introduction position, in which a control pin 44 of the fitting arrangement 24 can be introduced into the introduction portion 54, an end portion of the introduction portion 54 abuts, preferably at least partially, the fixing portion 52 so that an impact of the control pin 44 on the introduction portion 54 is discharged into the fixing portion 52 via the end portion which abuts the fixing portion 52. The introduction portion 54 is preferably pivotable out of the positive-locking connection with respect to the fixing portion 52, preferably by a control arm 40 of the fitting arrangement 24, on which in particular the control pin 44 is also arranged or constructed, so that the introduction portion 54 can subsequently be displaced by the control pin 44. The control element 46 may have a free-running member 82 by which the outward pivoting of the introduction portion 54 is brought about only when the fitting arrangement 24 is opened but not when the fitting arrangement 24 is closed.

The invention claimed is:

1. A fitting arrangement for connecting a slidable and tiltable leaf to a fixed frame of a window or a door, wherein the fitting arrangement has the following:

a) a scissor type deployment means having a deployment arm and a control arm which is movably arranged on the deployment arm, wherein the scissor type deployment means has a control pin;

b) a control element having a fixing portion which can be fixed to the fixed frame and an introduction portion having a slotted introduction member for receiving the control pin, wherein the introduction portion is arranged so as to be movable relative to the fixing portion between an introduction position, in which the control pin can be introduced and withdrawn into/from the slotted introduction member, and a tilted position, in which the control pin is retained on the control element, wherein the introduction portion adjoins in the introduction position the fixing portion partially in a positive-locking manner so that it cannot be moved into the tilted position by the control pin in order to discharge the impact by the control pin being introduced into the slotted introduction member directly into the fixing portion, wherein the scissor type deployment means is constructed to release the introduction portion which abuts the fixing portion in a partially positive-locking manner from the introduction position when the scissor type deployment means is opened so that the introduction portion can be moved into the tilted position by the control pin, wherein the introduction portion can be pivoted by the scissor type deployment means out of the partial positive-locking connection in the introduction position and can subsequently be displaced into the tilted position.

2. The fitting arrangement according to claim 1, wherein the fixing portion has an introduction recess in which the introduction portion in the introduction position abuts in a partially positive-locking manner so that the introduction portion cannot be moved into the tilted position by the control pin.

3. The fitting arrangement according to claim 1, wherein the introduction portion in the introduction position can be pivoted out of the partial positive-locking connection about the axis of the control pin or parallel with the axis of the control pin.

4. The fitting arrangement according to claim 1, wherein the introduction portion is released by the control arm out of the introduction position during opening of the scissor type deployment means.

5. The fitting arrangement according to claim 1, wherein the control element has a free-running member, by means of which jamming of the scissor type deployment means does not occur when the leaf is closed but the introduction portion is released from the introduction position which abuts the fixing portion in a partially positive-locking manner when the scissor type deployment means is opened.

6. The fitting arrangement according to claim 5, wherein the free-running member has a free-running pin which, in a state acted on counter to the resilient force of a free-running spring, is redirected by the scissor type deployment means during closure of the scissor type deployment means and is not redirected during opening of the scissor type deployment means.

7. The fitting arrangement according to claim 1, wherein the control element has a reversibly releasable engagement device on the introduction portion in order to secure the introduction portion in a reversibly releasable manner in the tilted position if the introduction portion is in the tilted position and/or presses the introduction portion into the partial positive-locking connection in a reversibly releasable manner if the introduction portion is in the introduction position.

8. The fitting arrangement according to claim 7, wherein the engagement device has an engagement spring and an engagement element which is acted on with the resilient force of the engagement spring.

9. The fitting arrangement according to claim 1, wherein the fixing portion has a stop face for the control pin, wherein the stop face is continued by a side wall of the slotted introduction member.

10. The fitting arrangement according to claim 1, wherein the control element has a slotted guiding member for guiding the introduction portion relative to the fixing portion.

11. The fitting arrangement according to claim 1, wherein the control pin has an end-side head portion with an expanded cross-section.

12. The fitting arrangement according to claim 1, wherein the fitting arrangement has a leaf rail which can be mounted on the leaf and a slider which is movable relative to the fixed frame, wherein the deployment arm is arranged pivotably on the leaf rail at one end and pivotably on the slider at the other end.

13. The fitting arrangement according to claim 12, wherein the control arm has a control arm slotted guiding member, in which a control arm guide bolt engages in order to guide the opening and closing movement of the scissor type deployment means.

14. A window or door having the fitting arrangement according to claim 1, a fixed frame and a tiltable and slidable leaf, wherein the leaf is connected to the fixed frame by the fitting arrangement and the fixing portion is fixedly arranged directly or indirectly on the fixed frame.

* * * * *